US008833961B2

(12) United States Patent
Chen

(10) Patent No.: US 8,833,961 B2
(45) Date of Patent: Sep. 16, 2014

(54) MULTI-PURPOSE ILLUMINATION DEVICE

(75) Inventor: Yarn Chen Chen, Hsinchu (TW)

(73) Assignee: GEEE Creations, Inc., Zhubei, Hsinchu County (TW)

( * ) Notice: Subject to any disclaimer, the term of this patent is extended or adjusted under 35 U.S.C. 154(b) by 494 days.

(21) Appl. No.: 13/326,976

(22) Filed: Dec. 15, 2011

(65) Prior Publication Data

US 2012/0155069 A1 Jun. 21, 2012

(30) Foreign Application Priority Data

Dec. 16, 2010 (TW) ..... 99144220 A

(51) Int. Cl.

| | |
|---|---|
| ***F21L 4/08*** | (2006.01) |
| ***F21S 9/02*** | (2006.01) |
| ***F21L 4/00*** | (2006.01) |
| *F21Y 101/02* | (2006.01) |

(52) U.S. Cl.

CPC ..... *F21L 4/005* (2013.01); *F21L 4/085* (2013.01); *F21S 9/022* (2013.01); *F21Y 2101/02* (2013.01); *Y10S 362/802* (2013.01)

USPC ..... 362/183; 362/641; 362/642; 362/276; 362/802

(58) Field of Classification Search

CPC .. F21W 121/00; F21Y 2101/02; F21V 23/04; F21V 23/0414; F21V 23/0442; F21V 23/0457; F21V 23/0464; F21S 8/03; F21S 8/033; F21S 8/035

USPC ..... 362/183, 202, 205, 640, 641, 145, 147, 362/276, 802, 647

See application file for complete search history.

(56) References Cited

U.S. PATENT DOCUMENTS

| | | | | |
|---|---|---|---|---|
| 2006/0002110 | A1* | 1/2006 | Dowling et al. | 362/252 |
| 2010/0141153 | A1* | 6/2010 | Recker et al. | 315/149 |
| 2013/0242529 | A1* | 9/2013 | Wong | 362/20 |

* cited by examiner

*Primary Examiner* — Thomas Sember

(74) *Attorney, Agent, or Firm* — Muncy, Geissler, Olds & Lowe, P.C.

(57) ABSTRACT

A multi-purpose illumination device includes a lamp-holder body and a portable lighting device detachably installed in the lamp-holder body. The lamp-holder body has a partially transparent cover and a power converter. The power converter converts a utility power into a DC power. The portable lighting device has a housing, a charging circuit, a battery unit, a push-button unit, an LED driving circuit, an LED unit, and a controller. The controller is coupled to the push-button unit, the charging circuit, a detection mechanism, and the LED driving circuit for detecting a button pressing state of the push-button unit, whether there is utility power, and whether the portable lighting device is installed in the lamp-holder body to control the LED driving circuit to drive the LED unit to light. The portable lighting device can also be used as a backup power.

10 Claims, 6 Drawing Sheets

MULTI-PURPOSE ILLUMINATION DEVICE

CROSS REFERENCE TO RELATED APPLICATION

This application claims the benefits of the Taiwan Patent Application Serial Number 099144220, filed on Dec. 16, 2010, the subject matter of which is incorporated herein by reference.

BACKGROUND OF THE INVENTION

1. Field of the Invention

The present invention relates to a multi-purpose illumination device and, more particularly, to a multi-purpose illumination device, which can provide functions of a wall lamp, a night light, an emergency light, a portable emergency light, a flashlight, a warning indicator, and a portable power.

2. Description of Related Art

Urban buildings and mansions are widely spread in the modern living environments, which bring people a comfortable and convenient life. However, when natural or man-made disasters arrive, great damages may be caused. When a typical damage occurs, it normally comes with a power failure, resulting in a great disaster, regardless of day or night, since the lighting is lost. In addition, a conventional flashlight typically uses a primary battery, and thus the flashlight may not be used when the battery power is run out. Even if a rechargeable battery is used, it is likely to have no power in use because the flashlight is not connected to a charger for charging in usual. Therefore, it is desirable to provide an improved emergency light to increase the effectiveness.

As shown in FIG. 1, a typical emergency light 11 is connected to a utility socket 13 through a power line 12, such that the light 11 can be automatically turned on for providing emergency illumination when the utility power encounters a power failure, so as to provide the best performance of the emergency light. The light 11 has to be placed at an obvious location in home to thereby provide emergency illumination as soon as the utility power fails. However, the light 11 generally has a poor appearance and needs an external power line for connection, so that it is difficult to be combined with a typical home decoration for being placed at an obvious location in home. Therefore, the emergency light is unable to effectively work in the emergency condition of power failure. In addition, the light 11 cannot be moved easily to a place where the emergency light us required when the utility power fails. Instead, lighting is typically limited to a local location where the emergency light is placed, and thus the emergency light cannot effectively work. Further, a typical emergency light functions only for lighting, which is desired to be improved.

SUMMARY OF THE INVENTION

The object of the present invention is to provide a multi-purpose illumination device, which can be used as a wall lamp, a night light, an emergency light, a portable emergency light, a flashlight, a warning indicator, and a portable power.

To achieve the object, the invention provides a multi-purpose illumination device, comprising a lamp-holder body having a partially transparent cover and a power converter for converting a utility power into a direct current (DC) power, and a portable lighting device detachably installed in the lamp-holder body. The portable lighting device has a housing with a detection mechanism to detect whether the portable lighting device is installed in the lamp-holder body, a charging circuit arranged in the housing and coupled to the power converter for receiving the DC power when the portable lighting device is installed in the lamp-holder body, a battery unit arranged in the housing and coupled to the charging circuit for being charged by the DC power, a push-button unit arranged on the housing, a light emitting diode (LED) driving circuit arranged in the housing, an LED unit arranged in the housing and coupled to the LED driving circuit, and a controller arranged in the housing, powered by the battery unit, and coupled to the push-button unit, the charging circuit, the detection mechanism, and the LED driving circuit, so as to detect a button pressing state of the push-button unit, whether there is utility power or not, and whether the portable lighting device is installed in the lamp-holder body thereby controlling the LED driving circuit to drive the LED unit to light based on a detected result. The portable lighting device further has a USB connector capable of supplying power which is converted from the battery to an electronic device, so as to function as a portable power in an emergency.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
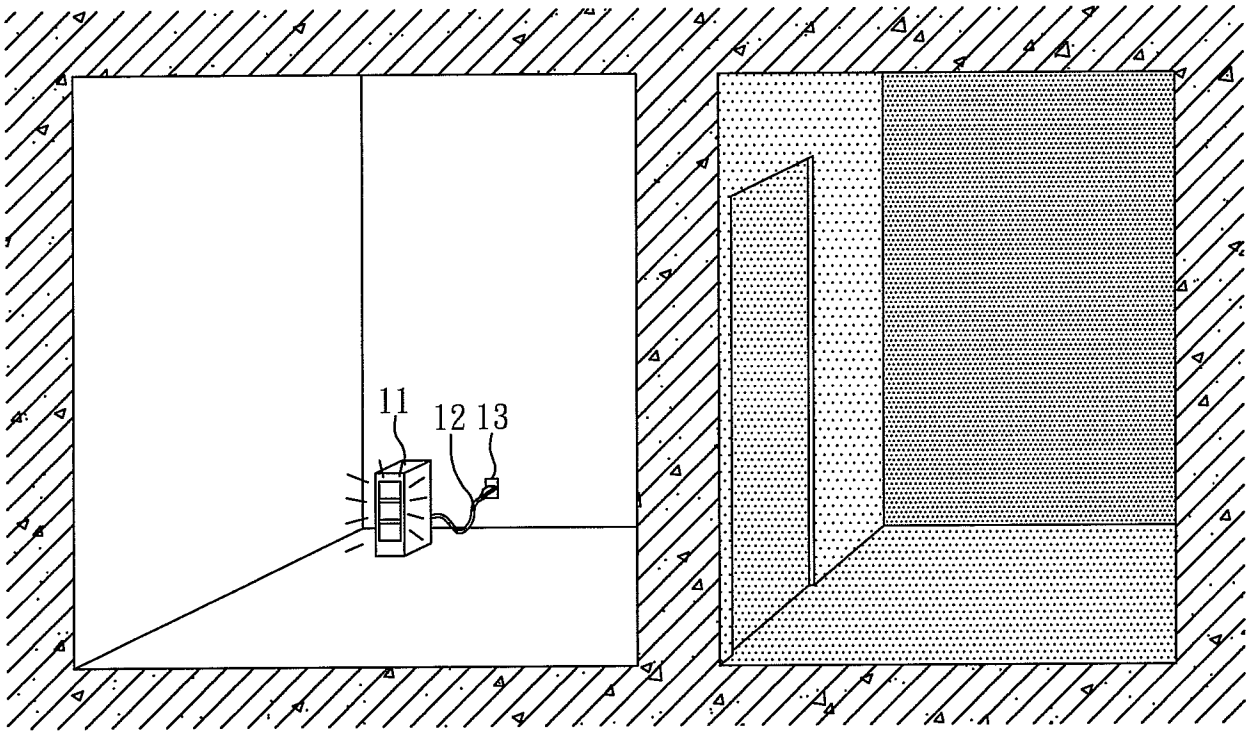
FIG. 1 (PRIOR ART)
FIG. 1 is a schematic view illustrating a typical emergency light.
Figure 2B:
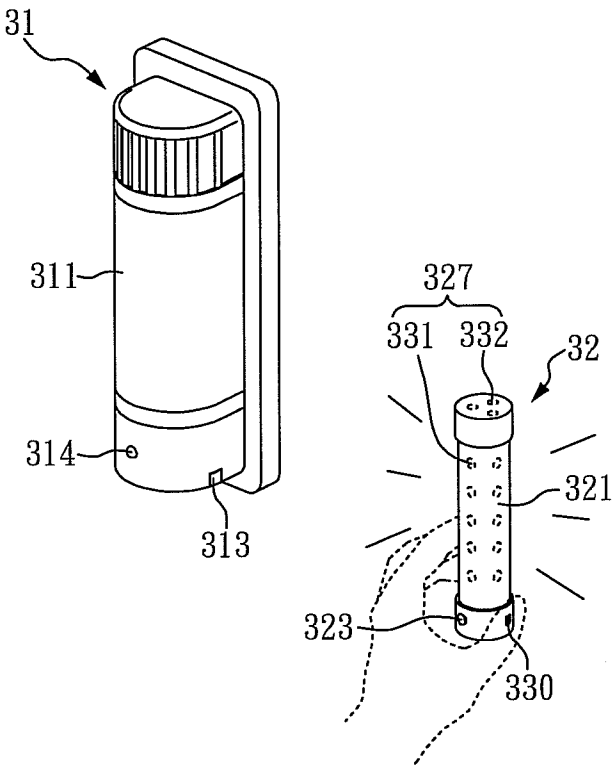
FIG. 2B is a schematic view illustrating a second use state of the multi-purpose illumination device in accordance with the present invention.
Figure 2A:
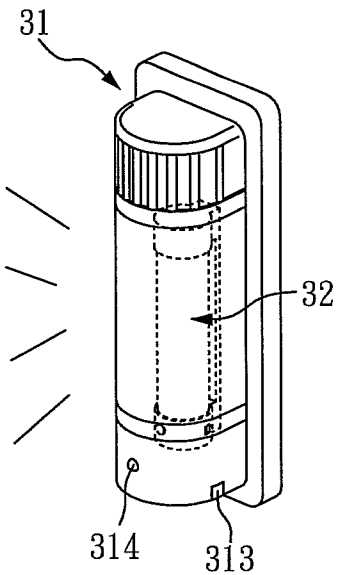
FIG. 2A is a schematic view illustrating a first use state of the multi-purpose illumination device in accordance with the present invention.

With reference to FIGS. 2A and 2B, there is shown a multi-purpose illumination device in accordance with a preferred embodiment of the present invention. The multi-purpose illumination device includes a lamp-holder body 31 and a portable lighting device 32 detachably installed in the lamp-holder body 31. FIG. 2A is a schematic view illustrating a first use state of the multi-purpose illumination device in accordance with the present invention in which the portable lighting device 32 is installed in the lamp-holder body 31. In this case, the multi-purpose illumination device can provide the functions of a wall lamp, a night light, and an emergency light, wherein the lamp-holder body 31 is provided with a latch mechanism 313 in order to take out the portable lighting device 32 installed in the lamp-holder body 31 when the latch mechanism 313 is pressed by a user. FIG. 2B is a schematic view illustrating a second use state of the multi-purpose illumination device in accordance with the present invention in which the portable lighting device 32 installed in the lamp-holder body 31 is taken out. In this case, the multi-purpose illumination device can provide the functions of a flashlight, a portable emergency light, a warning indicator, and a portable power.

Figure 3:
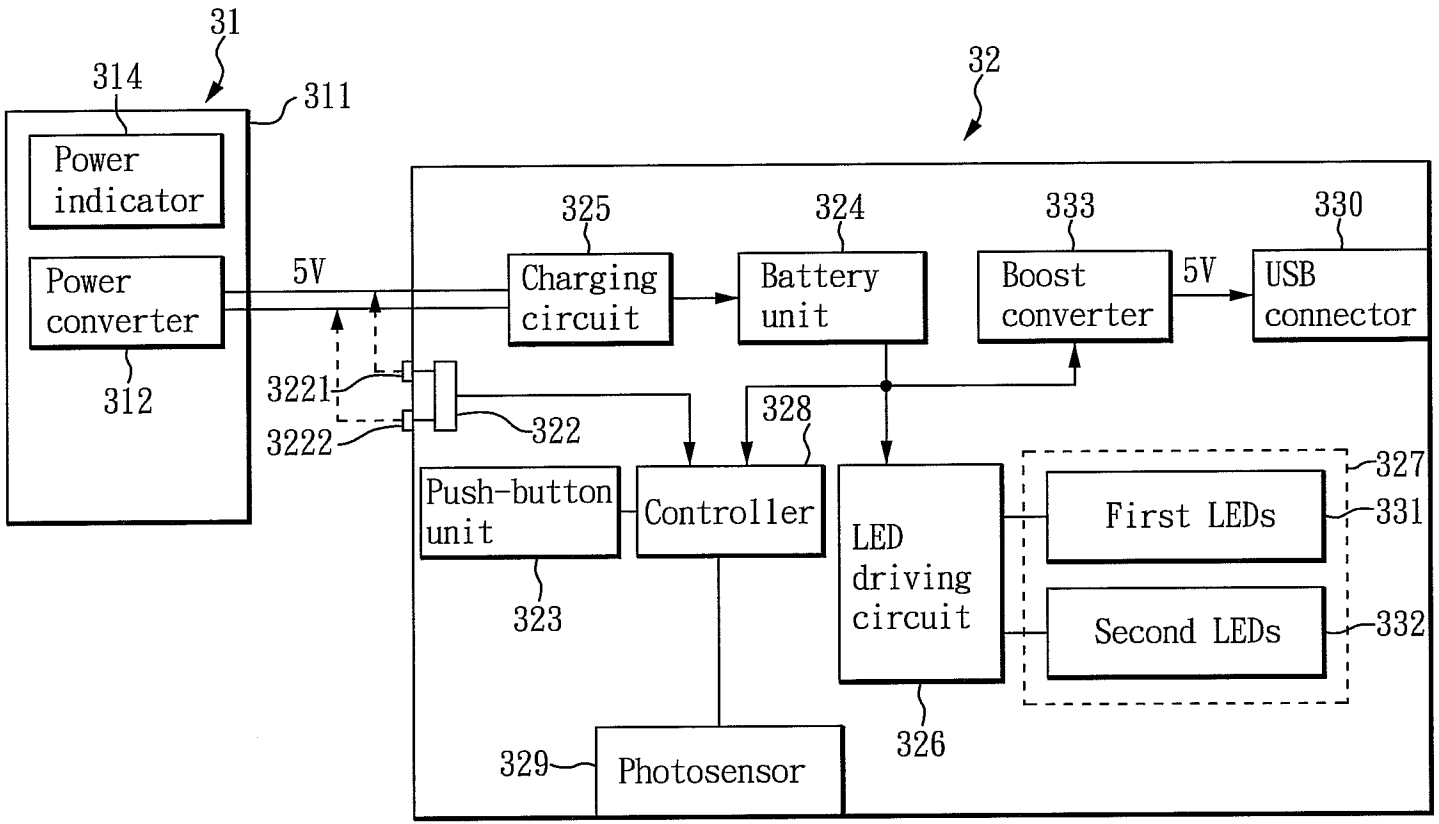
FIG. 3 is a schematic view illustrating the structure of the multi-purpose illumination device in accordance with the present invention.

FIG. 3 is a schematic view illustrating the structure of the lamp-holder body 31 and portable lighting device 32 of the multi-purpose illumination device according to the invention. As shown in FIGS. 2A, 2B, and 3, the lamp-holder body 31 has a partially transparent cover 311, a power converter 312, and a power indicator 314. The power converter 312 is provided to convert a utility power into a DC power (5V). The power indicator 314 is provided to indicate whether the power converter 312 is connected to the utility power.

The portable lighting device 32 includes: a housing 321, a detection mechanism 322, a push-button unit 323, a battery unit 324, a charging circuit 325, an LED driving circuit 326, an LED unit 327, a photosensor 329, a controller 328, a boost converter 333, and a USB connector 330. The detection mechanism 322 detects whether the portable lighting device 32 is installed in the lamp-holder body 31. An implementation of the detection mechanism 322 is to provide two contact electrodes 3221, 3222 arranged on the housing 321 of the portable lighting device 32. In this case, by detecting that the two contact electrodes 3221, 3222 are at an electrified state as the two contact electrodes 3221, 3222 come into touch with DC power output of the power converter 312, the controller 328 can determine that the portable lighting device 32 is installed in the lamp-holder body 31. On the contrary, when the controller 328 detects that the two contact electrodes 3221, 3222 are at a non-electrified state, it indicates that the portable lighting device 32 installed in the lamp-holder body 31 is taken out. Another implementation of the detection mechanism 322 is to provide a contact switch arranged on the housing 321 of the portable lighting device 32. In this case, the contact switch is turned on due to being pressed by the partially transparent cover 311 when the portable lighting device 32 is installed in the lamp-holder body 31, so that the controller 328 can be aware of the portable lighting device 32 being installed in the lamp-holder body 31 by detecting that the contact switch is turned on. On the contrary, when the controller 328 detects that the contact switch is turned off, it indicates that the portable lighting device 32 installed in the lamp-holder body 31 is taken out.

The push-button unit 323, the photosensor 329, and the USB connector 330 are arranged on the housing 321 of the portable lighting device 32. The push-button unit 323 is used by a user to control the portable lighting device 32. The photosensor 329 can obtain an environmental brightness around the lamp-holder body 3 through the transparent portion of the lamp-holder body 3 to thereby control lighting of the portable lighting device 32. The photosensor 329 can be a photosensitive resistor or a passive infrared (PIR) sensor. The USB connector 330 can be connected to an external electronic device for supplying power thereto. The charging circuit 325, the LED driving circuit 326, the LED unit 327, the controller 328, and the boost converter 333 are arranged in the housing 321. When the portable lighting device 32 is installed in the lamp-holder body 31, the charging circuit 325 is coupled to the power converter 312 of the lamp-holder body 31 in order to receive the DC power. The battery unit 324 is coupled to the charging circuit 325, such that the charging circuit 325 can use the DC power to charge the battery unit 324. The controller 328 is powered by the battery unit 324 and the controller 328 is coupled to the push-button unit 323, the charging circuit 325, the detection mechanism 322, the photosensor 329, and the LED driving circuit 326, so as to detect a button pressing state of the push-button unit, whether utility power is presented or not, and whether the portable lighting device is installed in the lamp-holder body or not, and the environmental brightness, so as to control a lighting type of the portable lighting device 32. The boost converter 333 is coupled to the USB connector 330 and the battery unit 324 in order to convert the power of the battery unit 324 into the USB power for the USB connector 330. The LED driving circuit 326 is further coupled to the LED unit 327 and the battery unit 324 in order to drive the LED unit 327 for lighting under the control of the controller 328. The LED unit 327 includes a plurality of first LEDs 331 arranged on the front side of the housing 321 of the portable lighting device 32 and a plurality of second LEDs 332 placed on the lateral sides of the housing of the portable lighting device 32.

Figure 4:
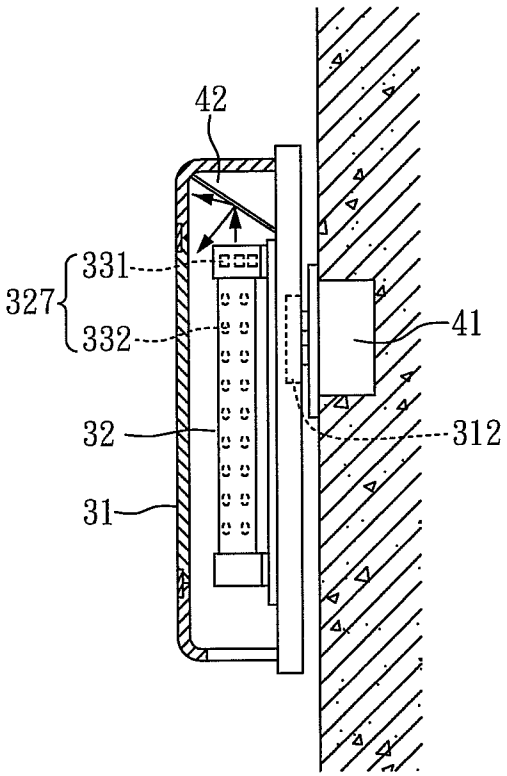
FIG. 4 is a cross-sectional view of the multi-purpose illumination device in accordance with the present invention.

FIG. 4 is a cross-sectional view of the multi-purpose illumination device in accordance with the present invention. As shown, in the multi-purpose illumination device, the power converter 312 of the lamp-holder body 31 is inserted into the utility socket 41 disposed on a wall surface, so as to allow the utility power to power and turn on the LED unit 327. In addition, an optical path redirector 42 can be placed on the top of the lamp-holder body 31 to change the direction of a light beam from the portable lighting device 32 installed in the lamp-holder body 31. The optical path redirector 42 can be, for example, a mirror with an acute angle from the top surface of the portable lighting device 32 so as to change the direction of the light beam emitted from the plurality of first LEDs 331 arranged on the front side of the portable lighting device 32 and guide the light beam to emit toward a direction opposite to the wall surface.

Figure 5:
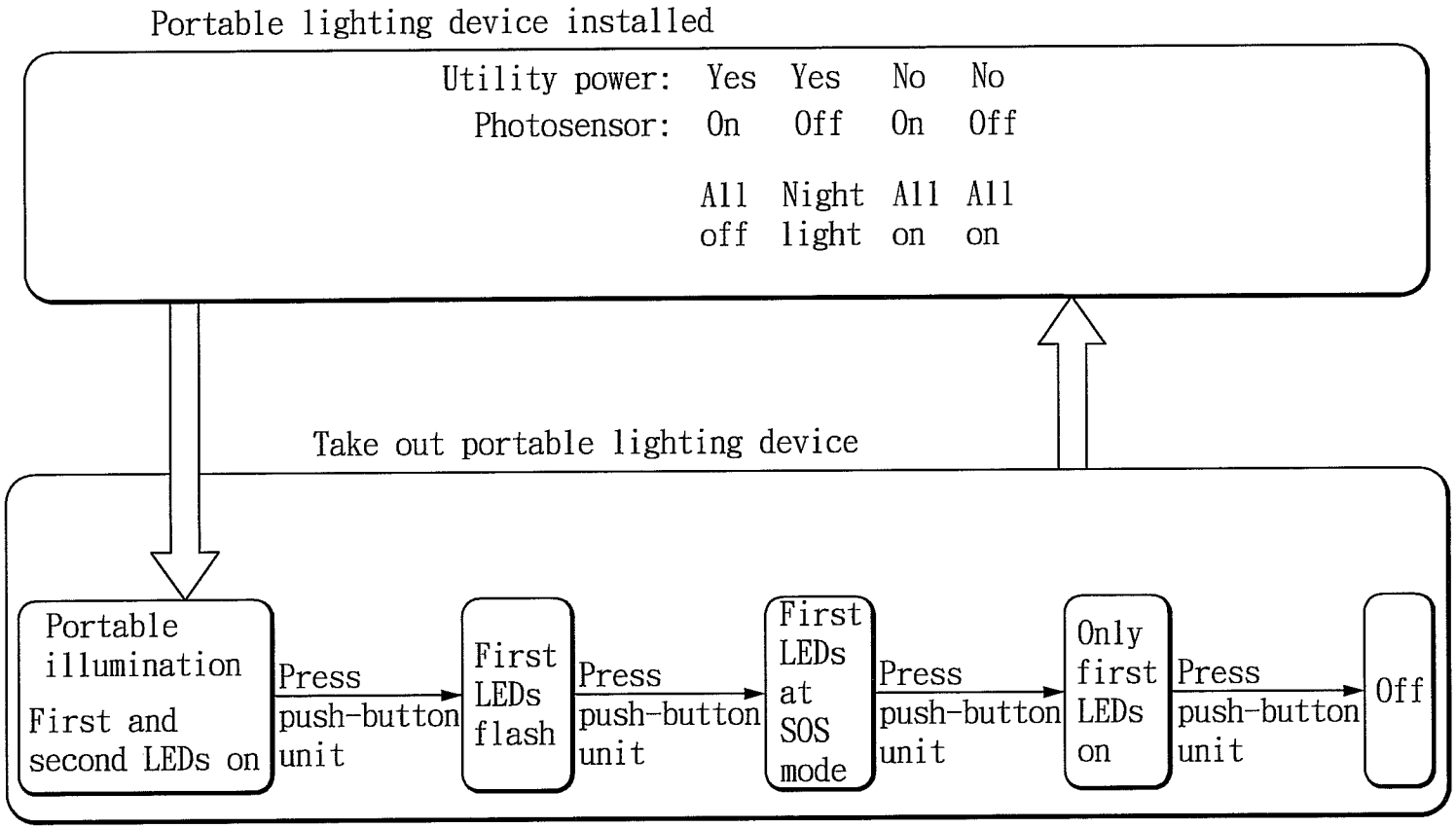
FIG. 5 is a schematic view illustrating the operation of the multi-purpose illumination device in accordance with the present invention.

FIG. 5 is a schematic view illustrating the operation of the multi-purpose illumination device in accordance with the present invention. As shown in FIG. 5, when the portable lighting device 32 is installed in the lamp-holder body 31, the LED unit 327 is controlled to be turned on or off for lighting based on the factors of whether the utility power exists or not and the environmental brightness detected by the photosensor 329. When the portable lighting device 32 is taken out, the LED unit 327 is controlled to be turned on or off for lighting by pressing the push-button unit 323 can be pressed to control. Thus, when the multi-purpose illumination device is plugged into the utility socket 41 on the wall surface, it can be used as a night light as the controller 328 detects that the utility power is presented and the portable lighting device 32 is installed in the lamp-holder body 31. In this case, the photosensor 329 can detect the environmental brightness, such that the controller 328 can control the LED driving circuit 326 to drive the LED unit 327 to light for providing the night illumination when the environmental brightness at night is lower than a predetermined value. In addition, when the multi-purpose illumination device is used as the night light, the brightness of the LED unit 327 can be automatically adjusted with a different environmental brightness detected by the photosensor 329.

When encountering a power failure, the controller 328 can detect that the utility power does not exist and the portable lighting device 32 is installed in the lamp-holder body 31. In this case, the multi-purpose illumination device can be used as an emergency light, so that the controller 328 controls the LED driving circuit 326 to drive all the first LEDs 331 and the second LEDs 332 to light for providing emergency illumination at the condition of having no utility power. The light beam emitted by the first LEDs 331 can be concentrated and redirected via the lamp-holder body, so as to enhance the directivity and brightness of the emergency light.

In addition, users can press the latch mechanism 313 to take out the portable lighting device 32 installed in the lamp-holder body 31, so that the portable lighting device 32 is used as a flashlight. At this moment, the detection mechanism 322 detects that the portable lighting device 32 is taken out from the lamp-holder body 31, so that the controller 328 enters into a flashlight mode to turn on the first LEDs 331 and the second LEDs 332. The controller 328 determines its lighting mode based on the detected pressing state of the push-button unit 323. For example, when the push-button unit 323 is pressed one time, the portable lighting device 32 is configured to enter into a warning mode, i.e., the first LEDs 331 flash; when the push-button unit 323 is pressed one time again, the first LEDs 331 arranged on the front side of the portable lighting device 32 become an SOS (help) mode; when the push-button unit 323 is pressed one time again, only the first LEDs 331 arranged on the front side of the portable lighting device 32 are turned on for entering into a portable illumination mode; when the push-button unit 323 is pressed one time again, a portable power mode is entered in which the first LEDs 331 and the second LEDs 332 are turned off; and when the push-button unit 323 is pressed one time again, it returns to the flashlight mode.

At the condition of having no utility power, users can follow the emergency light to find the position of the multi-purpose illumination device, and further press the latch mechanism 313 to take out the portable lighting device 32 installed in the lamp-holder body 31 for using the portable lighting device 32 as a flashlight in the power failure environment or for moving the portable lighting device 32 to a location requiring more emergency illumination.

Figure 6:
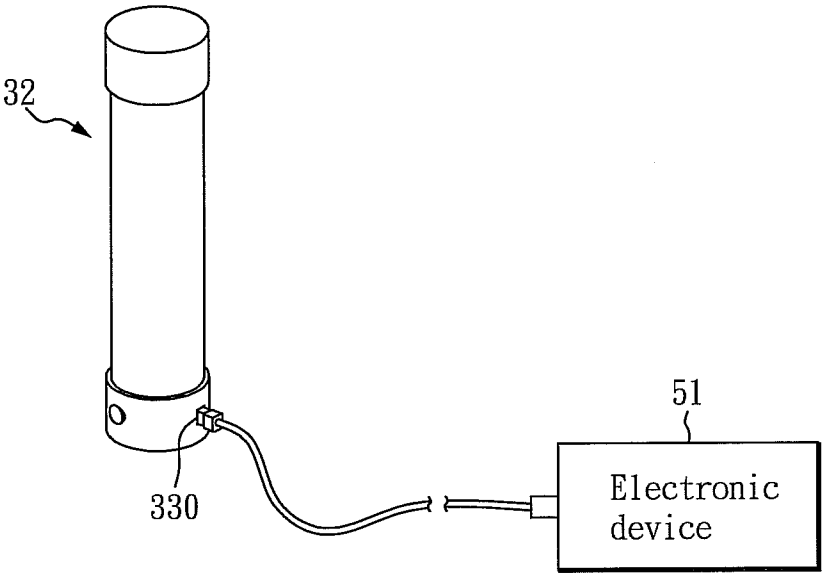
FIG. 6 is a schematic view illustrating the multi-purpose illumination device used as a portable power in accordance with the present invention.

In addition, at the condition of power failure, the multi-purpose illumination device can be further used as a portable power. As shown in FIG. 6, users can connects an electronic device 51 with a USB interface to the USB connector 330 of the portable lighting device 32 so as to power or charge the electronic device 51. Thus, when there is a power failure and no utility power can be provided to power or charge an electronic device, users still can use the multi-purpose illumination device to allow the electronic device 51 to work normally, so as to eliminate the inconvenience caused by no utility power and enhance the usability of the illumination device, thereby encouraging general consumers to purchase the devices.

As cited, the invention combines various illumination functions into an illumination device, which can provide an emergency illumination to users at the condition of power failure, which can take out the portable lighting device installed in the lamp-holder body for use as a flashlight when the utility power is presented or not presented, which can be used as a light source (a night light or portable emergency light) when the external environmental brightness is detected to be insufficient, and which can charge an electronic device through the USB connector at the condition of power failure. Therefore, the invention relatively increases the use convenience.

Although the present invention has been explained in relation to its preferred embodiment, it is to be understood that many other possible modifications and variations can be made without departing from the spirit and scope of the invention as hereinafter claimed.

What is claimed is:

1. A multi-purpose illumination device, comprising:

a lamp-holder body having a partially transparent cover and a power converter for converting a utility power into a DC power; and a portable lighting device detachably installed in the lamp-holder body, the portable lighting device including:

a housing having a detection mechanism for detecting whether the portable lighting device is installed in the lamp-holder body or not;

a charging circuit arranged in the housing, the charging circuit being coupled to the power converter for receiving the DC power when the portable lighting device is installed in the lamp-holder body;

a battery unit arranged in the housing and coupled to the charging circuit for being charged by the DC power;

a push-button unit arranged on the housing;

an LED driving circuit arranged in the housing, an LED unit arranged in the housing and coupled to the LED driving circuit, and a controller arranged in the housing, powered by the battery unit, and coupled to the push-button unit, the charging circuit, the detection mechanism, and the LED driving circuit, so as to detect a button pressing state of the push-button unit, whether utility power is presented or not, and whether the portable lighting device is installed in the lamp-holder body or not, thereby controlling the LED driving circuit to drive the LED unit to light based on a detected result.

2. The multi-purpose illumination device as claimed in claim 1, wherein the controller controls the LED driving circuit to drive the LED unit to light when there is no utility power and the portable lighting device is installed in the lamp-holder body, thereby providing an emergency light.

3. The multi-purpose illumination device as claimed in claim 2, wherein the LED unit includes a plurality of first LEDs arranged on a front side of the housing of the portable lighting device and a plurality of second LEDs arranged on lateral sides of the housing of the portable lighting device, such that all the first LEDs and the second LEDs are turned on for providing the emergency light.

4. The multi-purpose illumination device as claimed in claim 2, wherein all the first LEDs and the second LEDs are turned on when the controller detects that the portable lighting device installed in the lamp-holder body is taken out, and subsequently the controller detects a button pressing state of the push-button unit to control the LED driving circuit to drive the first and the second LEDs for lighting.

5. The multi-purpose illumination device as claimed in claim 2, wherein the portable lighting device further includes a photosensor arranged on the housing of the portable lighting device and connected to the controller for detecting an environmental brightness around the lamp-holder body through a transparent portion of the lamp-holder body, such that the controller controls the LED driving circuit to drive the LED unit to light for providing a night light when the environmental brightness is lower than a predetermined value.

6. The multi-purpose illumination device as claimed in claim 5, wherein the photosensor is a photosensitive resistor or a passive infrared sensor.

7. The multi-purpose illumination device as claimed in claim 1, wherein the portable lighting device further includes:

a USB connector arranged on the housing; and a boost converter connected to the USB connector and the battery unit for converting a power of the battery unit into a USB power for being supplied to an electronic device connected to the USB connector.

8. The multi-purpose illumination device as claimed in claim 1, wherein a latch mechanism is arranged on the lamp-holder body for holding or releasing the portable lighting device in the housing of the lamp-holder body.

9. The multi-purpose illumination device as claimed in claim 1, wherein an optical path redirector is arranged in the lamp-holder body for changing a direction of light beam emitted by the portable lighting device installed in the lamp-holder body.

10. The multi-purpose illumination device as claimed in claim 1, wherein the detection mechanism includes two contact electrodes arranged on the housing, and the controller determines whether the portable lighting device is placed in the lamp-holder body or not by detecting whether the two contact electrodes are at an electrified state or not.

* * * * *